US006890389B2

(12) United States Patent
Okamiya et al.

(10) Patent No.: US 6,890,389 B2
(45) Date of Patent: May 10, 2005

(54) METHOD FOR TREATING SULFUR FREE-CUTTING ALLOY STEEL

(75) Inventors: Akio Okamiya, Nagano-ken (JP); Masato Nasu, Nagano-ken (JP)

(73) Assignee: Minebea Co., Ltd., Nagano-ken (JP)

( * ) Notice: Subject to any disclaimer, the term of this patent is extended or adjusted under 35 U.S.C. 154(b) by 0 days.

(21) Appl. No.: 10/198,375

(22) Filed: Jul. 18, 2002

(65) Prior Publication Data

US 2003/0070689 A1 Apr. 17, 2003

(30) Foreign Application Priority Data

Oct. 12, 2001 (JP) ..... 2001-314652

(51) Int. Cl.[7] ..... B08B 7/04; B08B 3/00

(52) U.S. Cl. ..... 134/1; 134/2; 134/3; 134/26; 134/28; 134/29; 134/42

(58) Field of Search ..... 134/1, 2, 3, 26, 134/28, 29, 34, 36, 42

(56) References Cited

U.S. PATENT DOCUMENTS 6,059,886 A * 5/2000 Shibano ..... 134/1
2003/0070689 A1 * 4/2003 Okamiya et al. ..... 134/1
2003/0072672 A1 * 4/2003 Hayaishi et al. ..... 420/125

FOREIGN PATENT DOCUMENTS

| | | |
|---|---|---|
| GB | 1 411 865 | 10/1975 |
| JP | 49-038805 | 4/1974 |
| JP | 60-190553 | 9/1985 |
| JP | 07-305110 | 11/1995 |
| JP | 09-071840 | 3/1997 |
| JP | 09-078187 | 3/1997 |
| JP | 09-157791 | 6/1997 |
| JP | 10-102119 | 4/1998 |
| JP | 11-140699 | 5/1999 |
| JP | 2003119584 * | 4/2003 |

* cited by examiner

*Primary Examiner*—Alexander Markoff
(74) *Attorney, Agent, or Firm*—Flynn, Thiel, Boutell & Tanis, P.C.

(57) ABSTRACT

In order to remove or decrease fine granular sulfides of Mn, Cr, Mo, etc. (Mn—S, Cr—S, Mo—S, etc.) left on a machined workpiece surface of sulfur free-cutting alloy steel without affecting the form and dimensional accuracy thereof, there is provided a method for treating the sulfur free-cutting alloy steel which comprises a soaking process of the machined workpiece in a solvent and an ultrasonic cleaning process by applying ultrasonic waves of 1.0 to 2.0 W/cm$^2$ in watt density at a frequency of 40 KHz or a multi frequency in the solvent.

8 Claims, 2 Drawing Sheets

CHEMICAL AND STRONG ULTRASONIC TREATMENT

CONVENTIONAL CLEANING

STRONG ULTRASONIC CLEANING

CHEMICAL AND STRONG ULTRASONIC TREATMENT

METHOD FOR TREATING SULFUR FREE-CUTTING ALLOY STEEL

BACKGROUND OF THE INVENTION

1. Field of the Invention

This invention relates to a method for treating sulfur free-cutting alloy steel used in the production of precision machine parts and, more particularly, relates to a method for treating sulfur free-cutting alloy steel to remove fine granular sulfide of Mn, Cr, Mo, etc. left on a machined surface of sulfur free-cutting alloy steel.

2. Prior Art

A machined surface of sulfur free-cutting alloy steel has been conventionally cleaned by applying ultrasonic waves of 0.3 to 0.9 W/cm$^2$ in watt density for 5 to 10 minutes without specifying frequency. Such ultrasonic cleaning has been effectively applied to usual precision machining and hardly caused troubles.

However, it has been found in the case of ultra-precision machine such as bearings for driving a small hard disk of superior high density, that fine granular sulfides of Mn, Cr, Mo, etc. (Mn—S, Cr—S, Mo—S, etc.) left on a machined surface of sulfur free-cutting alloy steel happens to drop out from the surface, thereby troublesomely crushing a disk or head of a hard disk drive (HDD).

The inventors have tried to remove or decrease such fine granular sulfides of Mn, Cr, Mo, etc. (Mn—S, Cr—S, Mo—S, etc.) left on the machined surface without affecting the form and dimensional accuracy when sulfur free-cutting alloy steel is machined into parts of a predetermined form and dimension.

As a result of the inventors' eager investigation, it has been found that an unexpected effect of ultrasonic cleaning is achieved by treating the surface with ultrasonic waves of 1.0 to 2.0 W/cm$^2$ in watt density at a frequency of 40 kHz or multi-frequency for 5 to 10 minutes in order to prevent drop-out of the fine granular sulfide of Mn, Cr, Mo, etc. (Mn—S, Cr—S, Mo—S, etc.) left on the machined surface of sulfur free-cutting alloy steel. The present invention is developed on the basis of this information.

SUMMARY OF THE INVENTION

The present invention provides a method for treating sulfur free-cutting alloy steel which comprises a soaking process of a machined workpiece of a sulfur free-cutting alloy steel in a solvent and a ultrasonic cleaning process thereof by applying ultrasonic waves of 1.0 to 2.0 W/cm$^2$ in watt density at a frequency of 40 kHz or multi-frequency in the solvent. The machined workpiece of the sulfur free-cutting alloy steel may be subjected to a chemical treatment before or after the ultrasonic cleaning, while the chemical treatment may be conducted with or without ultrasonic vibration.

The present method for treating sulfur free-cutting alloy steel may be performed by ultrasonic waves in the same or a different treating tank with plural aqueous solvents a few times. The plural aqueous solvents may be selected from water alone, water with a small amount of surfactants and water with a small amount of chemicals depending on the purpose.

The present method for treating sulfur free-cutting alloy steel comprises a rinsing process with water alone as a solvent followed by a drying process of machined workpiece of sulfur free-cutting alloy steel.

The rinsing process may be carried out with or without ultrasonic vibration.

A degreasing process for removing cutting oil from the machined workpiece surface may be additionally carried out before the process for soaking the machined sulfur free-cutting alloy steel in a solvent.

In general, cutting oil is used between alloy steel and cutting machine in a machining process to increase machining efficiency in aid of thus improved cooling and lubricating properties. This is the reason why it is necessary to carry out the degreasing process for removing the cutting oil left on the machined surface of alloy steel.

There are used surfactants for degreasing, which may include either of an anionic-, cationic- or non-ionic surfactant.

Further, the degreasing process may be carried out with or without ultrasonic vibration.

Chemicals used in the chemical treating process of the present invention include an oxidizing agent (peroxide), acid agent, alkaline agent and salt, which allows to removal of fine granular sulfides of Mn, Cr, Mo, etc (Mn—S, Cr—S, Mo—S, etc.) left on the surface of sulfur free-cutting alloy steel, through oxidation or dissolution thereby.

DETAILED DESCRIPTION OF THE INVENTION

Figure 1:
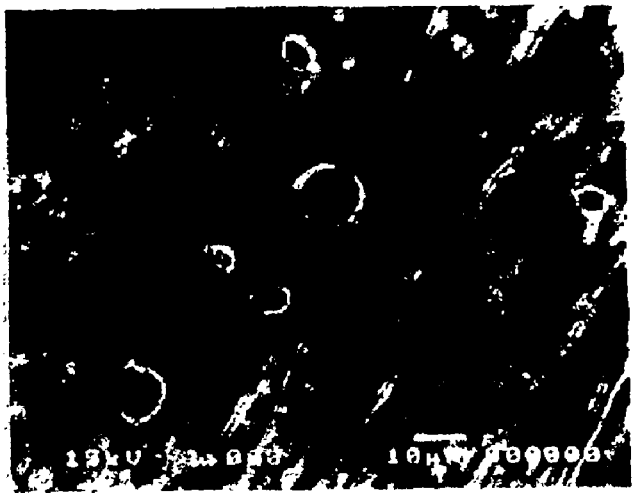
FIG. 1 is photomicrograph of a machined workpiece surface of a sulfur free-cutting alloy steel treated by conventional cleaning.

The present invention will be described in detail by the following embodiments.

Any kind of sulfur free-cutting alloy steel may be used in the present invention. For example, there may be used those sulfur free-cutting alloy steel materials described in Japanese Patent Laid-open Nos. S49-38,805, S60-190,553, H7-305,110, H9-71,840, H9-78,187, H9-157,791 and H10-102,119.

A solvent used in the present invention is preferably an aqueous one and includes water alone, water with a small amount of surfactants and water with a small amount of chemicals. In general, water contains oxygen as dissolved oxygen in an amount of 8 to 10 ppm, while it is confirmed that such dissolved oxygen generates a great number of bubbles, which inhibit and absorb cavitation caused by ultrasonic wave to decrease the ultrasonic effect. It has been found that water is subjected to a deaerating treatment to reduce dissolved oxygen to an extent of about 3 ppm or less so as to conduct ultrasonic cleaning without trouble.

Chemicals used in the present invention include an oxidizing agent (peroxide), acid agent, alkaline agent and salt. The oxidizing agent includes manganese peroxide, hydrogen peroxide, ammonium peroxide, etc. The acid agent includes an inorganic acid such as hydrochloric acid, nitric acid and sulfuric acid, an organic carboxylic acid such as propionic acid, and the like. The alkaline agent includes sodium hydroxide, potassium hydroxide, calcium hydroxide, magnesium hydroxide, etc. The salt includes ammonium fluoride, sodium chloride, potassium chloride, sodium nitride, sodium sulfide, sodium carbonate, etc.

Ultrasonic waves applied in the present invention are at a frequency of 40 kHz or multi-frequency. The multi-frequency used herein means superimposed ultrasonic waves of 25 to 300 kHz. Strength of ultrasonic waves applied in the present invention is watt density of 1.0 to 2.0 $W/cm^2$, because that of less than 1.0 $W/cm^2$ results in an insufficient effect and that of more than 2.0 $W/cm^2$ causes erosion.

A treating period of time may be for 3 to 15 minutes and preferably for 5 to 10 minutes. A shorter treating time results in an insufficient effect, while a longer time causes erosion.

Embodiments of the present invention will be summarized as in the following.

1. A method for treating sulfur free-cutting alloy steel which comprises a soaking process of a machined workpiece of sulfur free-cutting alloy steel in a solvent and an ultrasonic cleaning process by applying ultrasonic waves of 1.0 to 2.0 $W/cm^2$ in watt density and at a frequency of 40 kHz or multi-frequencies in the solvent.
2. A method for treating sulfur free-cutting alloy steel described above in item 1 in which the solvent is an aqueous solvent containing one or more chemicals selected from a group consisting of an oxidizing agent (peroxide), acid agent, alkaline agent and salt.
3. A method for treating sulfur free-cutting alloy steel described in the above item 1 or 2 in which ultrasonic cleaning is conducted more than one time in plural aqueous solvents.
4. A method for treating sulfur free-cutting alloy steel described in the above item 3 in which plural aqueous solvents are charged in the same tank or a different tank.
5. A method for treating sulfur free-cutting alloy steel described in any one of the above items 1 to 3 in which a machined workpiece of sulfur free-cutting steel alloy is soaked in an aqueous solvent containing one or more chemicals selected from a group consisting of an oxidizing agent (peroxide), acid agent, alkaline agent and salt for a predetermined period of time before conducting an ultrasonic cleaning process with or without applying ultrasonic waves.
6. A method for treating sulfur free-cutting alloy steel described in any one of the above items 1 to 5 in which a degreasing process for removing cutting oil from a machined workpiece surface of sulfur free-cutting alloy steel is performed before a soaking process of the machined workpiece in a solvent.
7. A method for treating sulfur free-cutting alloy steel described in any one of the above items 1 to 6 in which a rinsing process for rinsing a machined workpiece of sulfur free-cutting alloy steel is carried out after a ultrasonic cleaning in a solvent containing water alone for a predetermined period of time with or without applying ultrasonic waves, followed by a drying process.
8. A method for treating sulfur free-cutting alloy steel described in any one of the above items 1 to 7 in which water is subjected to a deaerating treatment to reduce an amount of dissolved oxygen to an extent of about 3 ppm or less and then used as an aqueous solvent.
9. A method for treating sulfur free-cutting alloy steel described in any one of the above items 1 to 8 in which a machined workpiece of sulfur free-cutting alloy steel is a HDD bearing part.

According to the present method for treating sulfur free-cutting alloy steel, a surface of a machined workpiece of a sulfur free-cutting alloy steel is stable and thus useful for producing superior precision parts quite effectively, which is also clear from Table 1 and electron micrographs in FIGS. 1 to 3 as will be shown later.

The present invention will be more specifically described in the following examples.

EXAMPLE 1

High manganese sulfur free-cutting alloy steel was machined to form an inner ring of 5 mm in inner diameter, 7 mm in outer diameter and 5 mm in length as a HDD bearing part. A water-soluble cutting oil of the polyoxyalkylene glycol type was used as the cutting oil. The inner ring was washed with water, then treated in a solvent of water alone to clean a surface thereof by applying ultrasonic waves of 2.0 $W/cm^2$ in watt density at a frequency of 40 kHz for 7 minutes and dried in a clean room. There was yielded a finished workpiece as an inner ring of 5 mm in inner diameter 7 mm in outer diameter and 5 mm in length.

EXAMPLE 2

The same high manganese sulfur free-cutting alloy steel as Example 1 was machined to form an inner ring of 5 mm in inner diameter, 7 mm in outer diameter and 5 mm in length as a HDD bearing part. The same-water soluble cutting oil of the polyoxyalkylene glycol type as Example 1 was used as cutting oil. The inner ring was washed with water, then treated in a solvent of water alone to clean a surface thereof by applying superimposed ultrasonic waves of 2.0 $W/cm^2$ in watt density at frequencies of 25 to 300 kHz for 7 minutes and dried in a clean room. There was yielded a finished workpiece as an inner ring of 5 mm in inner diameter, 7 mm in outer diameter and 5 mm in length.

EXAMPLE 3

The same high manganese sulfur free-cutting alloy steel as Example 1 was machined to form an inner ring of 5 mm in inner diameter, 7 mm in outer diameter and 5 mm in length as a HDD bearing part. The same water-soluble cutting oil of the polyoxyalkylene glycol type as Example 1 was used as the cutting oil.

The inner ring was washed with water, then treated in a solvent containing 0.5% by mass of potassium permanganate to clean a surface thereof by applying ultrasonic waves of 1.5 $W/cm^2$ in watt density at frequency of 40 kHz for 7 minutes, washed with water again, further treated in a solvent of water alone to rinse the surface by applying ultrasonic wave of 1.0 $W/cm^2$ in watt density at a frequency of 40 kHz for 2 minutes and dried in a clean room. There was yielded a finished workpiece as an inner ring of 5 mm in inner diameter, 7 mm in outer diameter and 5 mm in length.

EXAMPLE 4

The same high manganese sulfur free-cutting alloy steel as Example 1 was machined to form an inner ring of 5 mm in inner diameter, 7 mm in outer diameter and 5 mm in length as a HDD bearing part. The same water-soluble cutting oil of polyoxyalkylene glycol type as Example 1 was used as the cutting oil.

The inner ring was washed with water, then treated in a solvent containing 0.5% by mass of potassium permanganate to clean a surface thereof by applying superimposed ultrasonic waves of 1.5 W/cm$^2$ in watt density at multi-frequencies of 25 to 300 kHz for 7 minutes, washed with water again, further treated in a solvent of water alone to rinse the surface by applying ultrasonic waves of 1.0 W/cm$^2$ in watt density at a frequency of 40 kHz for 2 minutes and dried in a clean room. There was yielded a finished workpiece as an inner ring of 5 mm in inner diameter, 7 mm in outer diameter and 5 mm in length.

COMPARATIVE EXAMPLE

The same high manganese sulfur free-cutting alloy steel as Example 1 was machined to form an inner ring of 5 mm in inner diameter, 7 mm in outer diameter and 5 mm in length as a HDD bearing part. The same water-soluble cutting oil of the polyoxyalkylene glycol type as Example 1 was used as the cutting oil. The inner ring was washed with water, then treated in a solvent of water alone to clean a surface thereof by applying superimposed ultrasonic waves of 0.8 W/cm$^2$ in watt density at multi-frequencies of 25 to 28 kHz for 7 minutes and dried in a clean room. There was yielded a finished workpiece as an inner ring of 5 mm in inner diameter, 7 mm in outer diameter and 5 mm in length.

Pure water was kept in each inner ring of 5 mm in inner diameter, 7 mm in outer diameter and 5 mm in length as machined workpieces obtained by Examples 1 to 4 and the Comparative Example to count particles in the pure water by means of a particle counter. The result is shown in Table 1 below.

TABLE 1

| | Ex. 1 | Ex. 2 | Ex. 3 | Ex. 4 | Comparative Ex. |
|---|---|---|---|---|---|
| LPC value | 283,664 | 273,937 | 77,997 | 77,352 | 514,990 |
| Reduction rate (%) | 44.9 | 46.8 | 84.5 | 85.0 | 0.0 |

Figure 2:
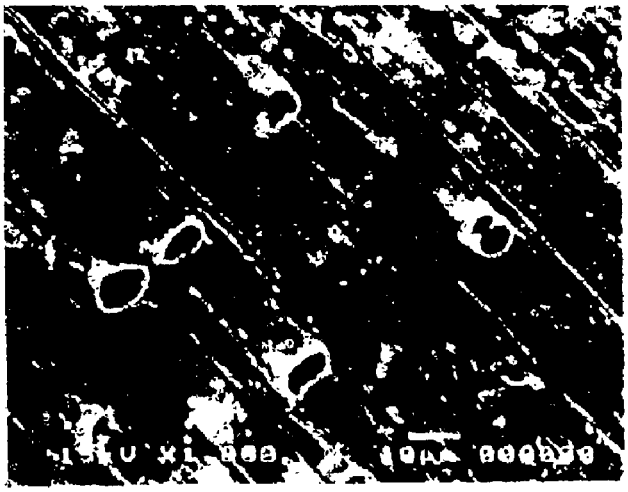
FIG. 2 is a photomicrograph of a machined workpiece surface of a sulfur free-cutting alloy steel according to to Example 1.
Figure 3:
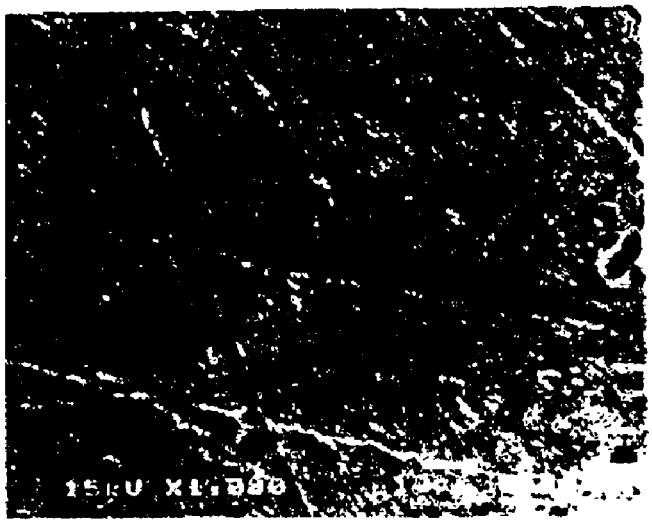
FIG. 3 is a photomicrograph of a machined workpiece surface of a sulfur free-cutting alloy steel according to Example 3.

Unit of LPC value: count of particles in each workpiece
Reduction rate: 100/100 - count in each Example/count of Comparative Example In FIGS. 1 to 3, there is shown electron micrographs of machined workpiece surfaces after utlrasonic cleaning treatment. FIG. 1 is electron micrographs of a machined workpiece surface after treated in a manner as described in Comparative Example according to conventional technology. FIGS. 2 and 3 are electron micrographs of machined workpiece surfaces after treated by strong ultrasonic waves as described in Example 1 and by both of a chemical and strong ultrasonic waves as described in Example 3, respectively.

It is clearly observed from the electron micrographs that fine particles, apparently sulfides of Mn, Cr, Mo, etc. are removed from pores formed on the machined workpiece surface.

What is claimed is:

1. A method of treating a machined workpiece of a sulfide-containing free-cutting alloy steel to remove granular sulfides of Mn, Cr and Mo from a surface thereof, comprising the steps of: soaking a machined workpiece of the sulfide-containing free-cutting alloy steel in an aqueous solvent consisting of water or water containing a member selected from the group consisting of an oxidizing agent, an acid, an alkaline agent and a salt, the aqueous solvent containing water having a dissolved oxygen content of no more than 3 ppm; and applying ultrasonic waves having a watt density of 1.0 to 2.0 W/cm$^2$ and a frequency of 40 kHz or superimposed ultrasonic waves of multi-frequencies of 25–300 kHz to the solvent containing the workpiece following the soaking step.

2. The method of claim 1, wherein the aqueous solvent contains at least one member selected from the group consisting of an oxidizing agent, an acid, an alkaline agent and a salt.

3. The method of claim 1, additionally comprising a step of degreasing the workpiece to remove a cutting oil from a surface thereof prior to the soaking step.

4. The method of claim 1, additionally comprising the steps of rinsing the workpiece after the ultrasonic waves have been applied thereto and drying the rinsed workpiece.

5. The method of claim 1, wherein the ultrasonic waves are applied to the solvent at a frequency of 40 kHz.

6. The method of claim 1, wherein superimposed ultrasonic waves are applied to the solvent at multi-frequencies of 25–300 kHz.

7. The method of claim 1, wherein the aqueous solvent is water.

8. The method of claim 1, wherein the aqueous solvent is water containing a member selected from the group consisting of an oxidizing agent, an acid, an alkaline agent and a salt.

* * * * *